US010775042B2

(12) United States Patent
Takashima et al.

(10) Patent No.: US 10,775,042 B2
(45) Date of Patent: Sep. 15, 2020

(54) COMBUSTION BURNER AND METHOD FOR MAINTAINING COMBUSTION BURNER

(71) Applicant: MITSUBISHI HITACHI POWER SYSTEMS, LTD., Yokohama-shi, Kanagawa (JP)

(72) Inventors: Ryuhei Takashima, Tokyo (JP); Akimasa Takayama, Tokyo (JP); Keigo Matsumoto, Tokyo (JP); Noboru Kawamoto, Kanagawa (JP); Ryuichiro Tanaka, Kanagawa (JP)

(73) Assignee: MITSUBISHI HITACHI POWER SYSTEMS, LTD., Yokohama-shi (JP)

( * ) Notice: Subject to any disclaimer, the term of this patent is extended or adjusted under 35 U.S.C. 154(b) by 121 days.

(21) Appl. No.: 16/077,611

(22) PCT Filed: Dec. 27, 2016

(86) PCT No.: PCT/JP2016/088902
§ 371 (c)(1),
(2) Date: Aug. 13, 2018

(87) PCT Pub. No.: WO2017/141551
PCT Pub. Date: Aug. 24, 2017

(65) Prior Publication Data

US 2019/0049106 A1 Feb. 14, 2019

(30) Foreign Application Priority Data

Feb. 15, 2016 (JP) ..... 2016-026181

(51) Int. Cl.
*F23D 1/02* (2006.01)
*F23C 7/00* (2006.01)

(52) U.S. Cl.
CPC ..... *F23D 1/02* (2013.01); *F23C 7/00* (2013.01); *F23D 2201/10* (2013.01); *F23D 2201/20* (2013.01); *F23D 2201/30* (2013.01)

(58) Field of Classification Search
CPC ..... F23D 2201/10; F23D 2201/101; F23D 2201/20; F23D 2201/30; F23D 2900/01001; F23D 2900/00018
See application file for complete search history.

(56) References Cited

U.S. PATENT DOCUMENTS 4,356,975 A * 11/1982 Chadshay ..... F23D 1/00 239/419.5
4,520,739 A * 6/1985 McCartney ..... F23D 1/00 110/263

(Continued)

FOREIGN PATENT DOCUMENTS

JP 56-133507 A 10/1981
JP 60-55815 U 4/1985

(Continued)

OTHER PUBLICATIONS

International Search Report and Written Opinion dated Feb. 28, 2017, issued in counterpart International Application No. PCT/JP2016/088902, with English translation. (22 pages).

(Continued)

*Primary Examiner* — David J Laux
(74) *Attorney, Agent, or Firm* — Westerman, Hattori, Daniels & Adrian, LLP

(57) ABSTRACT

A combustion burner includes a fuel nozzle configured to blow in fuel gas of solid fuel and air, a combustion air nozzle configured to blow in air from the outside of the fuel nozzle, and at least one flame stabilizer arranged on the axial center side at a distal end of the fuel nozzle. The flame stabilizer is arranged at the distal end, and has a flame stabilizing member whose width increases in a direction toward the (Continued)

distal end, and a straightening vane having a plate shape and being arranged on an extension of the flame stabilizing member on the upstream side in a flow direction of the fuel gas. An abrasion-resistant member is arranged on a wide width surface of the flame stabilizer, and an abrasion-resistant member is arranged on at least a part of the straightening vane.

9 Claims, 9 Drawing Sheets

(56) References Cited

U.S. PATENT DOCUMENTS

| | | | | |
|---|---|---|---|---|
| 4,634,054 | A * | 1/1987 | Grusha | F23C 5/06 239/423 |
| 5,215,259 | A * | 6/1993 | Wark | F23D 1/00 110/263 |
| 5,365,865 | A | 11/1994 | Monro | |
| 5,685,242 | A | 11/1997 | Narato et al. | |
| 6,089,171 | A * | 7/2000 | Fong | F23C 5/06 110/104 B |
| 6,439,136 | B1 | 8/2002 | Mann et al. | |
| 9,127,836 | B2 * | 9/2015 | Matsumoto | F23D 1/00 |
| 9,593,795 | B2 * | 3/2017 | Bliss | F16L 57/06 |
| 9,671,108 | B2 * | 6/2017 | Matsumoto | F23D 1/00 |
| 9,857,077 | B2 * | 1/2018 | Adam | F23K 3/02 |
| 10,174,939 | B2 * | 1/2019 | Coyle | F23D 1/00 |
| 10,281,142 | B2 * | 5/2019 | Matsumoto | F23C 6/045 |
| 2002/0174810 | A1 | 11/2002 | Penterson et al. | |
| 2010/0154688 | A1 * | 6/2010 | Adam | F23D 1/00 110/261 |
| 2012/0152158 | A1 | 6/2012 | Matsumoto et al. | |
| 2014/0011141 | A1 | 1/2014 | Matsumoto et al. | |

FOREIGN PATENT DOCUMENTS

| | | | |
|---|---|---|---|
| JP | 60-171307 | A | 9/1985 |
| JP | 61-41813 | A | 2/1986 |
| JP | 2-36713 | U | 3/1990 |
| JP | 2-109115 | U | 8/1990 |
| JP | 3-112618 | U | 11/1991 |
| JP | 7-260106 | A | 10/1995 |
| JP | 2002-228107 | A | 8/2002 |
| JP | 2005-265354 | A | 9/2005 |
| JP | 2011-127836 | A | 6/2011 |
| JP | 2013-7497 | A | 1/2013 |
| JP | 2014-105931 | A | 6/2014 |
| JP | 2015-52450 | A | 3/2015 |
| KR | 20-0397581 | Y1 | 5/2005 |
| WO | 2015/103831 | A1 | 7/2015 |

OTHER PUBLICATIONS

Office Action date Feb. 13, 2020, issued in counterpart IN Application No. 201847029569, with English translation (6 pages).

* cited by examiner

COMBUSTION BURNER AND METHOD FOR MAINTAINING COMBUSTION BURNER

FIELD

The present invention relates to a combustion burner applied to a boiler for generating steam for power generation, factories, or the like.

BACKGROUND

For example, a conventional pulverized coal fired boiler has a furnace that is formed in a hollow shape and installed in an up-and-down direction, and a plurality of combustion burners are arranged in a furnace wall along a circumferential direction, the combustion burners being arranged in a multiple-stage manner in the vertical direction. The combustion burner supplies thereto a fuel-air mixture of pulverized coal (fuel) in which coal is pulverized and primary air (air) and, at the same time, supplies thereto hot combustion air, wherein the fuel-air mixture and the hot combustion air are blown into the furnace to form flames thus combusting the fuel-air mixture in the furnace. Furthermore, the furnace has a flue gas duct connected with the upper portion thereof, the flue gas duct is provided with a superheater, a reheater, a fuel economizer, and the like that are used for recovering the heat of flue gas, and heat exchange is performed between the flue gas and water that are generated by combusting the fuel-air mixture in the furnace thus generating steam.

Here, in the combustion burner of the pulverized coal fired boiler, the fuel is composed of a solid material and hence, the fuel is brought into contact with a member arranged in an area through which the fuel circulates. Consequently, there exists the possibility of generating abrasion in a passage of the fuel, or the like. In this regard, Patent Literature 1 discloses a straightening vane arranged in the inside or the passage, the straightening vane being formed of a high-chrome steel material, or configured to apply thereto the lining of a hard material, such as ceramics or cermet.

CITATION LIST

Patent Literature

Patent Literature 1: Japanese Patent Application Laid-open No. 2005-265354

SUMMARY

Technical Problem

The combustion burner is provided with an abrasion-resistant member thus improving durability thereof. The combustion burner is provided with the abrasion-resistant member to improve the durability thereof thus reducing the frequency of maintenances, such as the replacement or repair of components; however, the replacement or repair of the components is required in some cases. In this case, there exists the case that the maintenance takes time and effort because of the abrasion-resistant member provided to the combustion burner.

The present invention has been made to overcome such drawbacks, and it is an object of the present invention to provide a combustion burner and a method for maintaining the combustion burner that are capable of maintaining high durability of the combustion burner and achieving easy maintenance of the combustion burner.

Solution to Problem

To achieve the object, a combustion burner of the present invention includes a fuel nozzle configured to blow in fuel gas that is a mixture of solid fuel and air; a combustion air nozzle configured to blow in air from outside of the fuel nozzle; at least one flame stabilizer having a wide width part whose width increases in a direction toward a distal end of the fuel nozzle, the flame stabilizer being arranged on the axial center side at the distal end of the fuel nozzle; and a straightening vane having a plate shape, the straightening vane being arranged on an extension of the flame stabilizer on the upstream side in a flow direction of the fuel gas. An abrasion-resistant member is arranged on the wide width part of the flame stabilizer. An abrasion-resistant member is arranged on at least a part of the straightening vane.

The combustion burner is provided with the respective abrasion-resistant members arranged on a part of the flame stabilizer, the width of the part being increased along with the extension of the flame stabilizer to the distal end of the combustion burner, and at least a part of the straightening vane thus protecting the part that is easily worn, and improving the durability of the combustion burner. Furthermore, the abrasion-resistant member is selectively arranged thus decreasing time and efforts for arranging the abrasion-resistant member at the time of maintenance, and easily maintaining the combustion burner. Consequently, it is possible to maintain high durability, and achieve easy maintenance.

The straightening vane is preferably arranged in a spaced-apart manner from the flame stabilizer in the flow direction of the fuel gas. The flame stabilizer and the straightening vane are formed in a separated manner from each other thus separately replacing each part of the flame stabilizer and the straightening vane. Consequently, it is possible to achieve easy maintenance.

The flame stabilizer preferably has an end surface located on the upstream side in the flow direction of the fuel gas, the end surface being orthogonal to the flow direction of the fuel gas. Consequently, the end surface of the flame stabilizer can be hardly scraped away by the solid contents in the combustion gas thus suppressing the occurrence of abrasion of the flame stabilizer.

It is preferable that the straightening vane has a surface parallel to the flow direction of the fuel gas, and the abrasion-resistant member is arranged in at least an area of the surface, the area being not greater than 50% of the overall length of the straightening vane from an end surface of the straightening vane located on the upstream side of the straightening vane in the flow direction of the fuel gas. Consequently, the abrasion-resistant member can be selectively arranged on the part that is easily worn thus decreasing the necessity of an abrasion-resistant treatment. Furthermore, it is possible to achieve easy maintenance.

The abrasion-resistant, member is preferably arranged on an end surface of the straightening vane located on the upstream side in the flow direction of the fuel gas. Consequently, a part with which the solid contents in the combustion gas are easily brought into contact can be protected thus improving abrasion resistance.

The straightening vane preferably has an end surface located on the upstream side in the flow direction of the fuel gas, the end surface being orthogonal to the flow direction of the fuel gas. Consequently, the end surface of the straightening vane can be hardly scraped away by the solid contents in the combustion gas thus suppressing the occurrence of abrasion of the flame stabilizer.

It is preferable that the fuel nozzle has a projection portion at a position facing the straightening vane, and the straightening vane has a recessed portion covering a periphery of the projection portion, the straightening vane being held with the projection portion arranged in the recessed portion. Consequently, the projection portion can be protected with the straightening vane thus suppressing the occurrence of replacement of the projection portion fixed to the fuel nozzle side at the time of maintenance. Furthermore, it is possible to improve maintainability.

The abrasion-resistant, member is preferably made of high-chrome steel. Consequently, a quantity of work when arranging the abrasion-resistant member in the straightening vane or the flame stabilizer can be reduced thus improving maintainability.

The abrasion-resistant member preferably has a structure such that ceramics is embedded in a metal member. Consequently, a quantity of work when arranging the abrasion-resistant member in the straightening vane or the flame stabilizer can be reduced thus improving maintainability.

At least one of the flame stabilizer and the straightening vane preferably has a permanent magnet arranged in an exposed manner to the fuel nozzle. Consequently, the magnetic force of the permanent magnet is checked from the outside of the combustion burner thus detecting the abrasion state of the permanent magnet, and determining the abrasion state of the straightening vane or the flame stabilizer from the abrasion state of the permanent magnet. The abrasion state of the permanent magnet can easily be detected thus achieving appropriate maintenance.

The flame stabilizer preferably has at least one group of at least two first flame stabilizing members arranged parallel with each other along a horizontal direction in a predetermined spaced apart manner in a vertical direction, and at least two second flame stabilizing members arranged parallel with each other along the vertical direction in a predetermined spaced apart manner in the horizontal direction. Consequently, flames can securely be formed from the inside of the fuel nozzle thus achieving excellent maintainability and abrasion resistance of the combustion burner.

To achieve the object, a method of the present invention is for maintaining a combustion burner that includes a fuel nozzle configured to blow in fuel gas that is a mixture of solid fuel and air, a combustion air nozzle configured to blow in air from outside of the fuel nozzle, at least one flame stabilizer having a wide width part whose width increases in a direction toward a distal end of the fuel nozzle, the flame stabilizer being arranged on the axial center side at the distal end of the fuel nozzle, and a straightening vane having a plate shape, the straightening vane being arranged on an extension of the flame stabilizer on the upstream side in a flow direction of the fuel gas. The method includes the steps of replacing the flame stabilizer with another flame stabilizer having the wide width part on which an abrasion-resistant member arranged; and replacing the straightening vane with another straightening vane on which an abrasion-resistant member is arranged on at least a part of the other straightening vane.

When maintaining a combustion burner, a flame stabilizer is replaced with another flame stabilizer whose flame stabilizing member has an abrasion-resistant member on a part of the flame stabilizing member, the width of the part being increased along with the extension of the flame stabilizing member to the distal end of the combustion burner, and a flow straightener is replaced with another flow straightener whose straightening vane has an abrasion-resistant member on at least a part thereof thus protecting the portion of the combustion burner that is easily worn, and improving the durability of the combustion burner. Furthermore, the abrasion-resistant member is selectively arranged thus decreasing time and efforts for arranging the abrasion-resistant member at the time of maintenance, and easily maintaining the combustion burner. Consequently, it is possible to maintain high durability, and achieve easy maintenance.

Advantageous Effects of Invention

According to the present invention, the respective abrasion-resistant, members are arranged on a part of the flame stabilizing member, the width of the part being increased along with the extension of the flame stabilizing member to the distal end of the combustion burner, and at least a part of the straightening vane thus protecting the part that is easily worn, and improving the durability of the combustion burner. Furthermore, the abrasion-resistant member is selectively arranged thus decreasing time and efforts for arranging the abrasion-resistant member at the time of maintenance, and easily maintaining the combustion burner. Consequently, it is possible to maintain high durability, and achieve easy maintenance.

DESCRIPTION OF EMBODIMENTS

Hereinafter, with reference to attached drawings, a preferred embodiment of a combustion burner according to the present invention are specifically explained. Here, the present invention is not limited to the embodiment, and when a plurality of embodiments are conceivable, the constitution of the embodiments combined with each other is included in the present invention.

Figure 1:
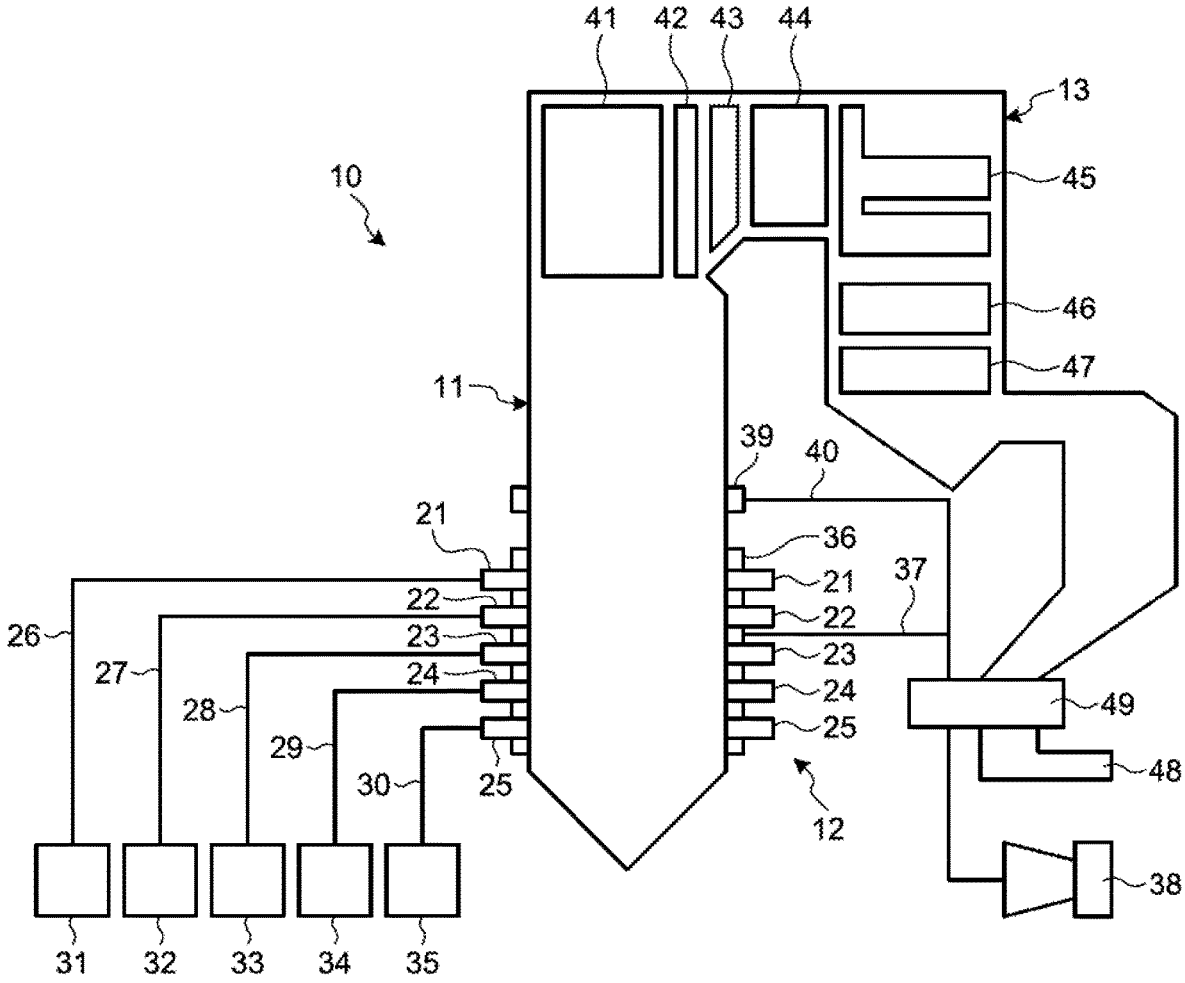
FIG. 1 is a schematic structural view illustrating a pulverized coal fired boiler to which a combustion burner according to the present embodiment is applied.
Figure 2:
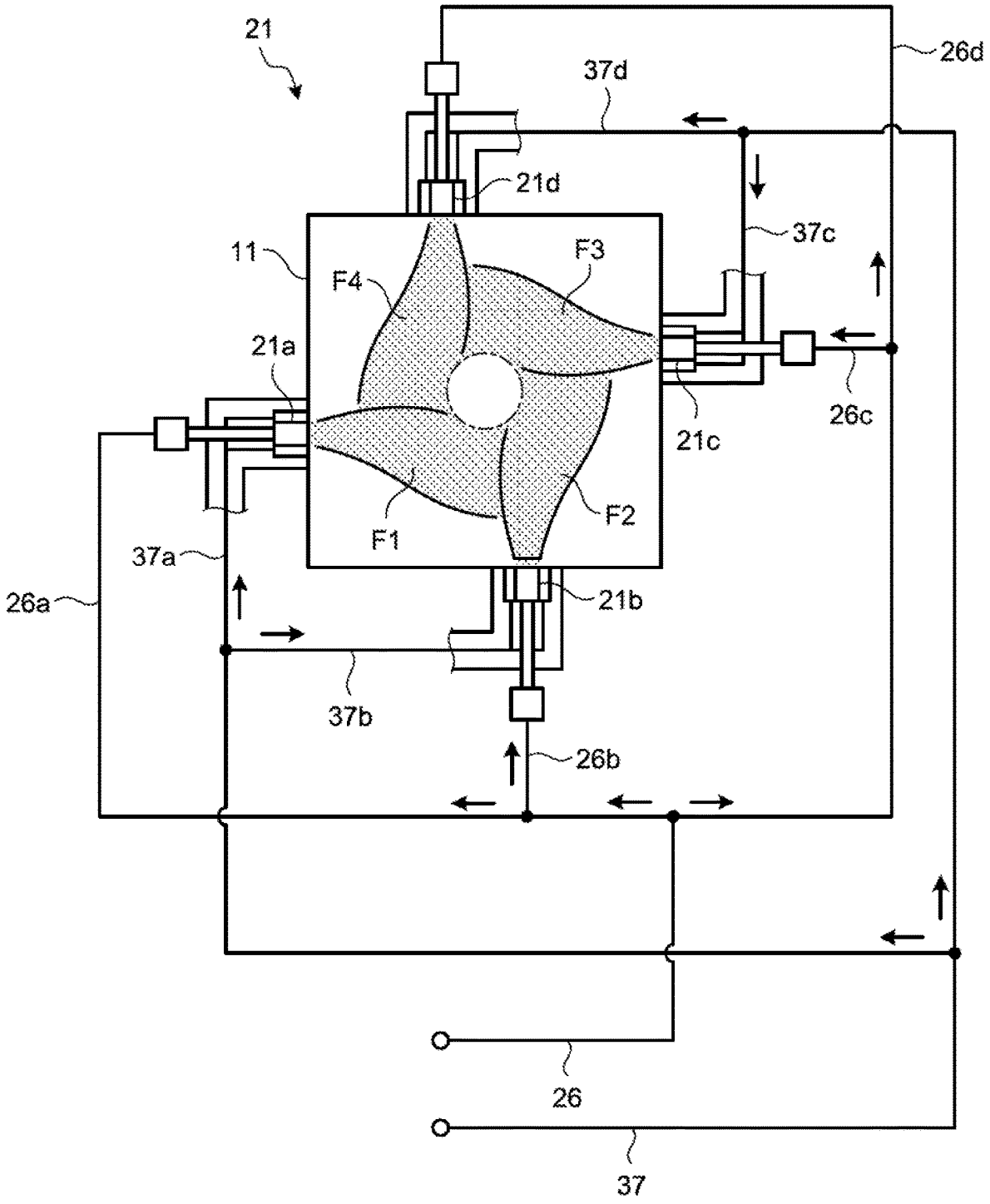
FIG. 2 is a plan view illustrating the combustion burner in the pulverized coal fired boiler according to the present embodiment.
Figure 3:
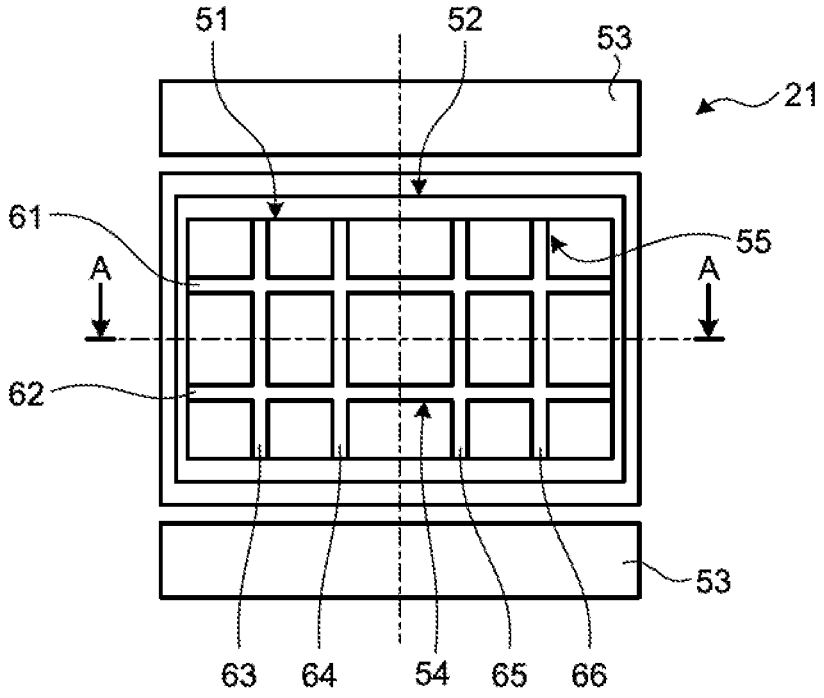
FIG. 3 is a front view illustrating the combustion burner according to the present embodiment.
Figure 4:
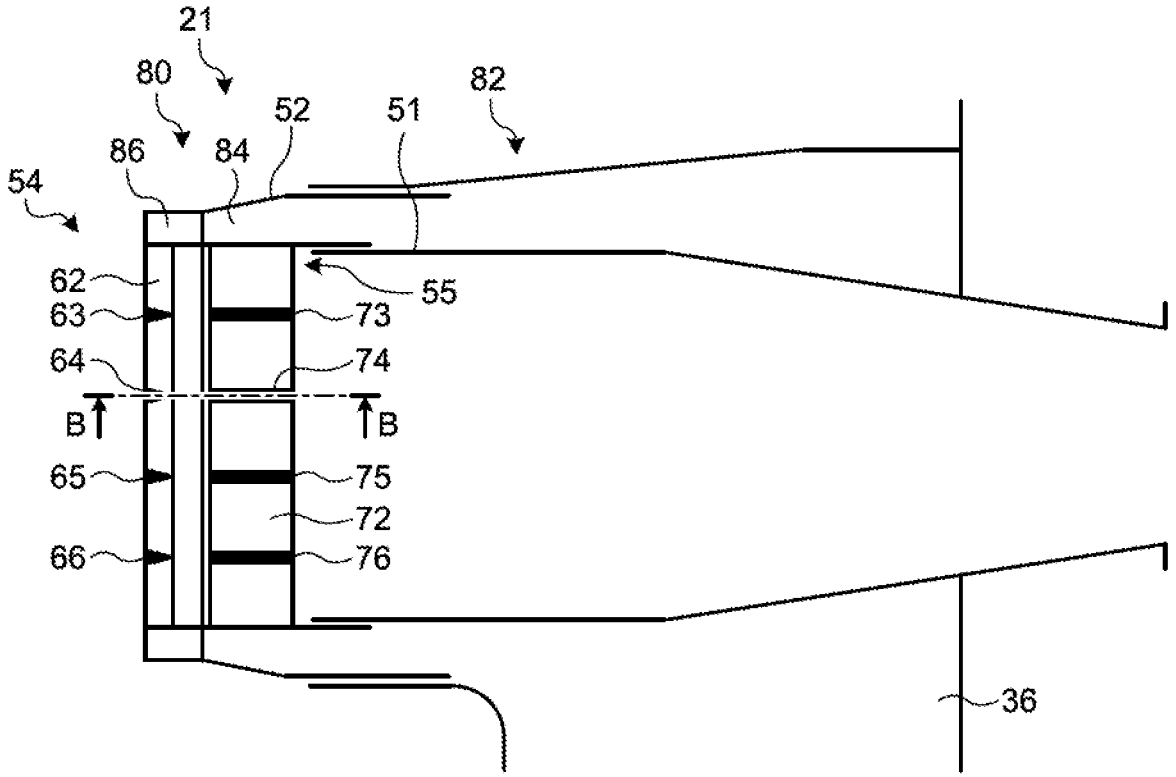
FIG. 4 is a sectional view taken along line A-A in FIG. 3, the sectional view illustrating the combustion burner according to the present embodiment.
Figure 5:
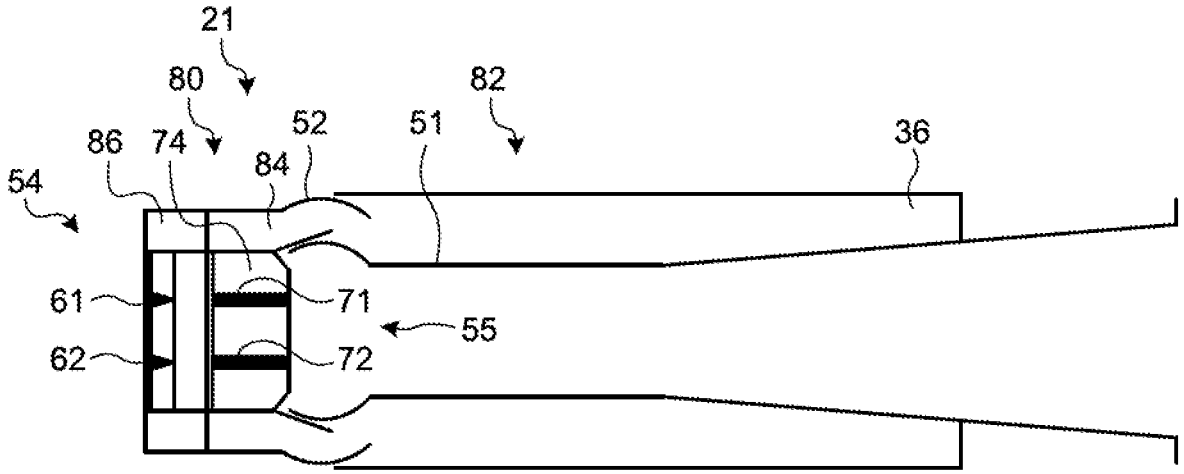
FIG. 5 is a sectional view taken along line B-B in FIG. 4, the sectional view illustrating the combustion burner according to the present embodiment.
Figure 6:
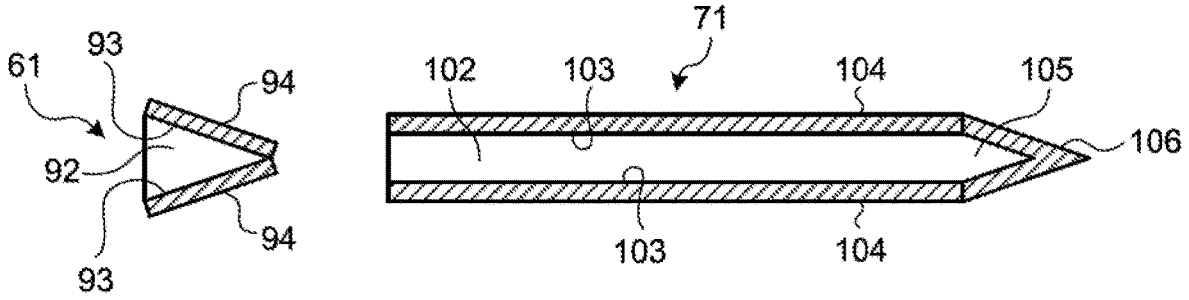
FIG. 6 is a schematic view illustrating a schematic structure of a flame stabilizing member and a straightening vane.

FIG. 1 is a schematic structural view illustrating a pulverized coal fired boiler to which a combustion burner according to the present embodiment is applied. FIG. 2 is a plan view illustrating the combustion burner in the pulverized coal fired boiler according to the present embodiment. FIG. 3 is a front view illustrating the combustion burner according to the present embodiment. FIG. 4 is a sectional view taken along line A-A in FIG. 3, the sectional view illustrating the combustion burner according to the present embodiment. FIG. 5 is a sectional view taken along line B-B in FIG. 4, the sectional view illustrating the combustion burner according to the present embodiment. FIG. 6 is a schematic view illustrating a schematic structure of a flame stabilizing member and a straightening vane.

The pulverized coal fired boiler to which the combustion burner according to the present embodiment is applied uses pulverized coal obtained by pulverizing coals, as a solid fuel, and burns the pulverized coal with the use of the combustion burner, the pulverized coal fired boiler being capable of recovering heat generated by the burning of the pulverized coal.

In the present embodiment, as illustrated in FIG. 1, a pulverized coal fired boiler 10 that is a conventional boiler has a furnace 11, a combustion device 12, and a flue gas duct 13. The furnace 11 is formed in a quadrilateral cylindrical hollow shape, and arranged along the perpendicular direction, and the combustion device 12 is arranged in the lower part of the furnace wall that constitutes the furnace 11.

The combustion device 12 has a plurality of combustion burners 21, 22, 23, 24, 25 attached to the furnace wall. In the combustion burners 21, 22, 23, 24, 25 according to the present embodiment, four combustion burners are arranged along the circumferential direction at equally spaced intervals as one set, and five sets of four combustion burners are arranged along the perpendicular direction; that is, five sets of four combustion burners are arranged in five stages.

Furthermore, the respective combustion burners 21, 22, 23, 24, 25 are connected with coal pulverizers (mills) 31, 32, 33, 34, 35 by way of pulverized coal feed pipes 26, 27, 28, 25, 30. Each of the coal pulverizers 31, 32, 33, 34, 35 has, although not illustrated in the drawings, a crushing table arranged in a housing thereof in such a manner that the crushing table is rotatably supported about a rotational axis thereof along the perpendicular direction, and each of a plurality of crushing rollers that face the upper surface of the crushing table is rotatably supported in an interlocking manner with the rotation of the crushing table. Accordingly, when the coals are supplied between the crushing rollers and the crushing table, each of the coals is here crushed to a predetermined size, and the pulverized coal classified by transportation air (air) is supplied from the pulverized coal feed pipes 26, 27, 28, 25, 30 to the combustion burners 21, 22, 23, 24, 25, respectively.

Furthermore, the furnace 11 includes thereon a wind box 36 in the fixing positions of the combustion burners 21, 22, 23, 24, 25, the wind box 36 connects therewith one end of an air duct 37, and the air duct 37 attaches an air blower 38 to the other end thereof. In addition, the furnace 11 includes thereon an additional air nozzle 39 in a position above the fixing positions of the combustion burners 21, 22, 23, 24, 25, and the additional air nozzle 39 connects thereto the end of a branch air duct 40 branched from the air duct 37. Consequently, combustion air (fuel-gas combustion air, secondary air) sent from the air blower 38 can be supplied from the air duct 37 to the wind box 36, and supplied from the wind box 36 to each of the combustion burners 21, 22, 23, 24, 25 and, at the same time, combustion air (additional air) sent from the air blower 38 can be supplied from the branch air duct 40 to the additional air nozzle 39.

Hence, in the combustion device 12, each of the combustion burners 21, 22, 23, 24, 25 is capable of blowing a fine powder fuel-air mixture (fuel gas) of the pulverized coal and air into the furnace 11 and, at the same time, blowing combustion-gas combustion air (secondary air) into the furnace 11, and an igniter (not illustrated in the drawings) ignites the fine powder fuel-air mixture thus forming flames.

Generally, at the time of starting a boiler, each of the combustion burners 21, 22, 23, 24, 25 injects oil fuel into the furnace 11 thus forming flames. Alternatively, after forming the flames with an oil-fired burner for start-up, during normal operation, combustion air is supplied from the oil-fired burner.

The furnace 11 connects the flue gas duct 13 to the upper portion thereof, and the flue gas duct 13 is provided with, as a convection heating part, superheaters (booster heaters) 41, 42 for recovering the heat of flue gas, reheaters 43, 44, and fuel economizers (economizers) 45, 46, 47, and heat exchange is performed between the flue gas generated in the burning of the fine powder fuel-air mixture in the furnace 11 and water.

The flue gas duct 13 connects a flue gas pipe 48 where flue gas heat-exchanged is discharged, to the downstream side thereof. Provided between the flue gas pipe 48 and the air ducts 37 is an air heater 49 to perform heat-exchange between the air flowing through the air duct 37, and the flue gas flowing through the flue gas pipe 48 thus heating the combustion air supplied to the combustion burners 21, 22, 23, 24, 25.

Accordingly, when the coal pulverizers 31, 32, 33, 34, 35 are operated, the pulverized coal generated and the transportation air are supplied to the combustion burners 21, 22, 23, 24, 25 through the respective pulverized coal feed pipes 26, 27, 28, 29, 30. Furthermore, the combustion air heated is supplied from the air duct 37 to each of the combustion burners 21, 22, 23, 24, 25 by way of the wind box 36 and, at the same time, supplied from the branch air duct 40 to the additional air nozzle 39. Then, the combustion burners 21, 22, 23, 24, 25 blow the fine powder fuel-air mixture of the pulverized coal and the transportation air into the furnace 11, and blow the combustion air into the furnace 11, and the fine powder fuel-air mixture is ignited thus forming flames. Furthermore, the additional air nozzle 39 blows the additional air into the furnace 11 thus performing combustion control. In the furnace 11, when the fine powder fuel-air mixture and the combustion air are burnt to form the flames, and the flames form in the lower part in the inside of the furnace 11, the combustion gas (flue gas) upwardly moves in the inside of the furnace 11 so as to be discharged to the flue gas duct 13.

That is, the combustion burners 21, 22, 23, 24, 25 blow the pulverized coal fuel-air mixture and the combustion air (combustion-gas combustion air/secondary air) into a combustion region in the furnace 11, and the pulverized coal fuel-air mixture is ignited thus forming a flame swirl flow in the combustion region. Furthermore, the flame swirl flow upwardly moves while swirling, and reaches to a reduced zone. The additional air nozzle 39 blows the additional air into above the reduced zone in the furnace 11. In the furnace 11, the amount of supply of air is set less than the theoretical quantity of air with respect to the amount of supply of pulverized coal thus holding a reducing atmosphere in the inside of the furnace 11. Furthermore, NOx generated by burning the pulverized coal is reduced in the furnace 11 and thereafter, the supplementary air (additional air) is supplied thus completing the oxidation combustion of the pulverized coal, and lowering a generation amount of NOx due to the burning of the pulverized coal.

Here, although the combustion device 12 is explained in detail, the combustion burners 21, 22, 23, 24, 25 that constitute the combustion device 12 have respective constitutions substantially identical with each other and hence, only the combustion burner 21 located at the uppermost position is explained.

The combustion burner 21 is, as illustrated in FIG. 2, constituted of combustion burners 21*a*, 21*b*, 21*c*, 21*d* arranged on respective four wall surfaces of the furnace 11. The combustion burners 21*a*, 21*b*, 21*c*, 21*d* connect thereto respective branch pipes 26*a*, 26*b*, 26*c*, 26*d* branched from the pulverized coal feed pipe 26, and connect thereto respective branch pipes 37*a*, 37*b*, 37*c*, 37*d* branched from the air duct 37.

Accordingly, each of the combustion burners 21*a*, 21*b*, 21*c*, 21*d* arranged on the respective wall surfaces of the furnace 11 blows the fine powder fuel-air mixture of the transportation air and the pulverized coal into the furnace 11, and blows the combustion air from the outside of the fine powder fuel-air mixture into the furnace 11. Furthermore, the fine powder fuel-air mixtures supplied from the respective combustion burners 21*a*, 21*b*, 21*c*, 21*d* are ignited thus forming four flames F1, F2, F3, F4, and each of the flames F1, F2, F3, F4 becomes the flame swirl flow that swirls in the counterclockwise direction as viewed from above the furnace 11 (in FIG. 2).

In the combustion burner 21 (21*a*, 21*b*, 21*c*, 21*d*) constituted as above, as illustrated in FIG. 3, FIG. 4, and FIG. 5, a fuel nozzle 51, a combustion air nozzle 52, and secondary air nozzles 53 are arranged in order from the center side of the combustion burner 21 and, at the same time, a flame stabilizer 54 and a flow straightener 55 are arranged. The fuel nozzle 51 is capable of blowing fuel gas (fine powder fuel-air mixture, primary air) such that the pulverized coal (solid fuel) and the transportation air (primary air) are mixed with each other, into the furnace 11. The combustion air nozzle 52 that is arranged on the outside of the fuel nozzle 51 is capable of blowing the combustion air (combustion air, secondary air) from the outer periphery side of the fuel gas injected from the fuel nozzle 51, into the furnace 11. One of the secondary air nozzles 53 is arranged in a position on the outside of the combustion air nozzle 52 and on the upper side of the combustion air nozzle 52 in the perpendicular direction, and the other one of the secondary air nozzles 53 is arranged in a position on the outside of the combustion air nozzle 52 and on the lower side of the combustion air nozzle 52 in the perpendicular direction. In this case, the perpendicular direction also includes a direction inclined from the perpendicular direction by a minute angle. The secondary air nozzle 53 is not arranged in a position on the outside of the combustion air nozzle 52 and adjacent to the combustion air nozzle 52 in the horizontal direction. The secondary air nozzle 53 is capable of blowing the secondary air (auxiliary air (AUX)) from the outer periphery side of the combustion-gas combustion air injected from the combustion air nozzle 52, into the furnace 11. Furthermore, the secondary air nozzle 53 may be arranged in a position on the outside of the combustion air nozzle 52 and adjacent to the combustion air nozzle 52 in the horizontal direction. Furthermore, when the secondary air nozzle 53 is arranged in a position on the outside of the combustion air nozzle 52 and adjacent to the combustion air nozzle 52 in the horizontal direction, it is unnecessary to arrange the secondary air nozzle 53 in a position adjacent to the combustion air nozzle 52 in the perpendicular direction. The secondary air nozzle 53 may be arranged on each of four outside surfaces of the combustion air nozzle 52. The secondary air nozzle 53 may include therein a damper opening adjustment mechanism or the like so that the amount of secondary air to be injected can be adjusted.

The combustion burner 21 has the fuel nozzle 51, the combustion air nozzle 52, an angle adjustment part 80, and a duct part 82 connected to the angle adjustment part 80 in a slidable manner. The angle adjustment part 80 is located on the distal end of the fuel nozzle 51 of the combustion burner 21 and the combustion air nozzle 52, and supported in a movable manner in a direction set with respect to the duct part 82. The direction in which the angle adjustment part 80 can be moved is not limited particularly, and the angle adjustment part 80 may be supported in a movable manner in the axial direction of the furnace 11 (in the perpendicular direction), or supported in a movable manner in the sectional direction of the furnace 11 (in the horizontal direction). The combustion burner 21 adjusts the direction of the angle adjustment part 80 thus adjusting the direction in which the fine powder fuel-air mixture of the pulverized coal and the transportation air is blown into the furnace 11. Furthermore, the angle adjustment part 80 has a proximal portion 84 to be moved with respect to the duct part 82, the proximal portion 84 including a fulcrum, and a distal end portion 86 located on the distal end side of the proximal portion 84, the distal end portion 86 constituting the end portion of the angle adjustment part 80 that is located close to the furnace 11. The distal end portion 86 is fixed to the proximal portion 84 with a fastener jig, such as a screw. Here, the distal end portion 86 may be fixed to the proximal portion 84 by welding.

The duct part 82, which is connected with the angle adjustment part 80, forms therein respective passages corresponding to the fuel nozzle 51, the combustion air nozzle 52, and the secondary air nozzle 53, and supplies the fuel gas such that pulverized coal and air are mixed with each other, and the combustion-gas combustion air to each part of the angle adjustment part 80. The duct part 82 is formed in an elongated tubular shape. The combustion burner 21 may include an angle adjustment part also in the secondary air nozzle 53 so that the angle of the secondary air nozzle 53 with respect to the axial direction of the duct part 82 can be adjusted in an integral manner with the fuel nozzle 51, and the combustion air nozzle 52. Furthermore, the combustion burner 21 may be constituted so that the secondary air nozzle 53 is fixed against movement, and the angle of the secondary air nozzle 53 with respect to the axial direction of the duct part 82 is not capable of being changed. Furthermore, in the present embodiment, although the angle adjustment part 80 is provided, it may be possible to adopt the constitution in which the distal end portion 86 configured to inject the fuel gas and the combustion-gas combustion air is fixed so as not to be moved with respect to the duct part 82.

The fuel nozzle 51 includes a straight pipe located on the distal end side thereof; that is, the straight pipe corresponds to the angle adjustment part 80, and the sectional area (opening area) of the straight pipe in a direction orthogonal to the direction in which the fine powder fuel-air mixture is blown into the furnace 11 is made constant. The combustion air nozzle 52 includes a distal end portion corresponding to the angle adjustment part 80, and the distal end portion is formed in a shape such that the distal end portion is shrunk in the direction toward the distal end of the combustion air nozzle 52; that is, the sectional area (opening area) of the distal end portion in a direction orthogonal to the direction in which the fine powder fuel-air mixture is blown into the furnace 11 is decreased in the direction toward the distal end of the combustion air nozzle 52. That is, the combustion air nozzle 52 is formed in a shape such that an area surrounded by the outside surfaces of the combustion air nozzle 52 is decreased along with the extension of the combustion air nozzle 52 from the downstream side to the upstream side in the flow direction of the fuel gas. The secondary air nozzle 53 includes a distal end portion corresponding to the angle adjustment part 80, and the distal end portion is formed in a shape such that the distal end portion is shrunk in the direction toward the distal end of the secondary air nozzle 53; that is, the sectional area (opening area) of the distal end portion in a direction orthogonal to the direction in which the fine powder fuel-air mixture is blown into the furnace 11 is decreased in the direction toward the distal end of the secondary air nozzle 53.

Here, the shape of the opening of each of the fuel nozzle 51 and the combustion air nozzle 52 is not limited to a square shape, and a rectangular shape or a circular shape may be adopted. In this case, a shape whose corner portion is rounded may be adopted. A tubular structure whose corner portion is rounded, or a cylindrical structure is adopted thus improving the strength of the nozzle.

The flame stabilizer 54 is arranged in the fuel nozzle 51, on the downstream side in the direction in which the fuel gas is blown into the furnace 11, and on the axial center side of the fuel nozzle 51 thus functioning as a device for igniting the fuel gas, and as a device for flame stabilizing. The flame stabilizer 54 is fixed to the distal end portion 86 of the angle adjustment part 80. The flame stabilizer 54 is constituted so that first flame stabilizing members 61, 62 each of which is formed along the horizontal direction, and second flame stabilizing members 63, 64, 65, 66 each of which is formed along the vertical direction (up-and-down direction) are arranged in a crossed manner; that is, the flame stabilizer 54 is formed of what is called a double cross split structure. Each of the first flame stabilizing members 61, 62 and the second flame stabilizing members 63, 64, 65, 66 has a wide width part whose width is increased in the direction toward the downstream side in the flow direction of the fuel gas. Each of the first flame stabilizing members 61, 62 and the second flame stabilizing members 63, 64, 65, 66 in the present embodiment is formed in an isosceles triangle shape as viewed in a sectional view, increased in width in the direction toward the downstream side in the flow direction of the fuel gas, and has a front end that constitutes a planar surface orthogonal to the flow direction of the fuel gas.

The flow straightener 55 is arranged in the inside of the fuel nozzle 51, and arranged closer to the upstream side than the flame stabilizer 54 in the flow direction of the fuel gas. Furthermore, the flow straightener 55 is fixed to the proximal portion 84 of the angle adjustment part 80. The flow straightener 55 is arranged in a spaced apart manner from the flame stabilizer 54 in the flow direction of the fuel gas. The flow straightener 55 straightens the flow of the fuel gas that flows in the inside of the fuel nozzle 51. The flow straightener 55 has first straightening vanes 71, 72 each of which is formed along the horizontal direction, and second straightening vanes 73, 74, 75, 76 each of which is formed along the vertical direction (up-and-down direction).

Each of the first straightening vanes 71, 72 and the second straightening vanes 73, 74, 75, 76 is basically formed in a plate-like shape being constant in thickness. The first straightening vanes 71, 72 and the second straightening vanes 73, 74, 75, 76 are arranged in a crossed manner. The first straightening vane 71 is arranged in a position overlapping with an extension of the first flame stabilizing member 61 in the flow direction of the fuel gas. In the same manner as above, the first straightening vane 72 is arranged in a position overlapping with an extension of the first flame stabilizing member 62 in the flow direction of the fuel gas. In the same manner as above, the second straightening vane 73 is arranged in a position overlapping with an extension of the second flame stabilizing member 63 in the flow direction of the fuel gas. In the same manner as above, the second straightening vane 74 is arranged in a position overlapping with an extension of the second flame stabilizing member 64 in the flow direction of the fuel gas. In the same manner as above, the second straightening vane 75 is arranged in a position overlapping with an extension of the second flame stabilizing member 65 in the flow direction of the fuel gas. In the same manner as above, the second straightening vane 76 is arranged in a position overlapping with an extension of the second flame stabilizing member 66 in the flow direction of the fuel gas.

Next, in conjunction with FIG. 6, the structure of each of the flame stabilizer 54 and the flow straightener 55 is explained. Although the first flame stabilizing member 61 of the flame stabilizer 54 and the first straightening vane 71 of the flow straightener 55 are explained in conjunction with FIG. 6, each of the other flame stabilizing members and each of the other straightening vanes are also similar in structures to the first flame stabilizing member 61 and the first straightening vane 71, respectively. As illustrated in FIG. 6, each of the first flame stabilizing member 61 and the first straightening vane 71 has an abrasion-resistant member arranged on the surface thereof. The first flame stabilizing member 61 has a base material 92, and abrasion-resistant members 94 arranged on the respective surfaces of the base material 92. The base material 92 is formed in an isosceles triangle shape, and has surfaces 93, the legs of the isosceles triangle shape, which are arranged in symmetry. The abrasion-resistant member 94 is arranged in an extending manner over the surface 93. The first straightening vane 71 has a base material 102, and abrasion-resistant members 104 arranged on the respective surfaces of the base material 102. The base material 102 is a plate member whose end portion 105 located on the upstream side in the flow direction of the fuel gas is formed in a triangle shape; that is, the end portion 105 is formed in a convex shape toward the upstream side in the flow direction of the fuel gas. That is, the end portion 105 is formed in a shape such that the width of the end portion 105 is decreased in the direction toward the upstream side in the flow direction of the fuel gas. The abrasion-resistant member 104 is arranged on a surface 103 of the base material 102 along the flow direction of the fuel gas, in an extending manner over the surface 103; that is, the abrasion-resistant member 104 is arranged on the surface 103 that is a surface having a largest area, in an extending manner over the surface 103. Furthermore, an abrasion-resistant member 106 is arranged in an extending manner over the end portion 105.

Each of the base materials 92, 102 can be, for example, formed of metal essentially composed of iron, such as stainless steel (SUS). The abrasion-resistant members 94, 104 are higher in abrasion resistances than the respective base materials 92, 102, and ceramics, a high-chrome steel material, and a composite material in which ceramics is embedded with metal can be used for the abrasion-resistant members 94, 104. When each of the abrasion-resistant members 94, 104 is, for example, made of ceramics, a plate made of ceramics is attached and fixed to the surface of each of the base materials 92, 102 thus arranging the abrasion resistant members 94, 104 on the respective surfaces of the base materials 92, 102. Furthermore, when each of the abrasion-resistant members 94, 104 is, for example, made of high-chrome steel, a high-chrome steel plate is fixed to each of the base materials 92, 102 by electrodepositing or welding thus arranging the abrasion-resistant members 94, 104 on the respective surfaces of the base materials 92, 102.

Each of the fuel nozzle 51 and the combustion air nozzle 52 has an elongated tubular structure, the fuel nozzle 51 has a rectangular-shaped opening, and the combustion air nozzle 52 has a rectangular ring-shaped opening. That is, the fuel nozzle 51 and the combustion air nozzle 52 constitute a double pipe structure. The respective secondary air nozzles 53 are arranged on the upper side and the lower side of the fuel nozzle 51 and the combustion air nozzle 52 in the vertical direction. As a result, the combustion air nozzle 52 is arranged on the outside of the opening of the fuel nozzle 51, and the secondary air nozzle 53 is arranged on the outside of the combustion air nozzle 52.

These nozzles 51, 52, 53 have the respective openings arranged coplanar with each other. Furthermore, the flame stabilizer 54 is supported by the inner wall surface of the fuel nozzle 51, or a plate (not illustrated in the drawings) from the upstream side of a passage through which the fuel gas flows. Furthermore, the fuel nozzle 51 is provided with the first flame stabilizing members 61, 62 and the second flame stabilizing members 63, 64, 65, 66 as the flame stabilizer 54, and the first straightening vanes 71, 72 and the second straightening vanes 73, 74, 75, 76 as the flow straightener 55 and hence, the passage of the fuel gas is divided into 15 areas. Furthermore, the flame stabilizer 54 is formed in a wedge shape such that the width of the flame stabilizer 54 is increased in the direction toward the front end portion of the flame stabilizer 54, and the front end surface of the flame stabilizer 54 is coplanar with the opening of each of the nozzles 51, 52, 53. Furthermore, the flow straightener 55 is formed in a plate shape, and extends in a direction along the angle adjustment part 80.

Accordingly, in the combustion burner 21, the fuel gas that is a mixture of pulverized coal and air is blown into the furnace 11 from the fuel nozzle 51 and, at the same time, the combustion-gas combustion air is blown into the furnace 11 from the combustion air nozzle 52 on the outside of the fuel nozzle 51, and the secondary air is blown into the furnace 11 from the secondary air nozzle 53 on the outside of the combustion air nozzle 52. The fuel gas that flows through the fuel nozzle 51 is straightened in a flow direction along the angle of the angle adjustment part 80 by the flow straightener 55. The fuel gas that is straightened by the flow straightener 55 and blown into the furnace 11 is branched by the flame stabilizer 54 in the opening of the fuel nozzle 51, and ignited thus burning the fuel gas and generating combustion gas. Furthermore, the combustion-gas combustion air is blown into the furnace 11 from the outer periphery of the fuel gas thus accelerating the combustion of the fuel gas. Furthermore, the secondary air is blown into the outer periphery of combustion flames, and the ratio of the combustion-gas combustion air to the secondary air is adjusted thus obtaining the optimum combustion.

Furthermore, in the combustion burner 21, the flame stabilizer 54 is formed in a split shape and hence, the fuel gas is branched by the flame stabilizer 54 in the opening of the fuel nozzle 51. In this case, the flame stabilizer 54 is arranged in a central area of the opening of the fuel nozzle 51, and ignition of the fuel gas and flame stabilization of the fuel gas are performed in the central area. Consequently, internal flame stabilization (flame stabilization in the central area of the opening of the fuel nozzle 51) of combustion flames is achieved.

Accordingly, the outer peripheral portion of the combustion flames assumes low temperature as compared with a constitution where external flame stabilization of the combustion flames is performed, and oxygen consumption in the inside of flames causes a low oxygen state thus lowering the temperature of the outer peripheral portion of the combustion flames under a high oxygen atmosphere by the combustion-gas combustion air, and reducing a generation amount of NOx in the outer peripheral portion of the combustion flames.

Here, in the combustion burner 21, the constitution that performs the internal flame stabilization is adopted and hence, it is preferable that each of the fuel gas and the combustion air (combustion-gas combustion air, and secondary air) be supplied as a rectilinear flow. That is, it is preferable that each of the fuel nozzle 51, the combustion air nozzle 52, and the secondary air nozzle 53 have a structure such that each of the fuel gas, the combustion-gas combustion air, and the secondary air supplied as a rectilinear flow in the burner axial direction without swirling the fuel gas, the combustion-gas combustion air, and the secondary air. Each of the fuel gas, the combustion-gas combustion air, and the secondary air is injected as a rectilinear flow to form the combustion flames and hence, in the constitution that performs the internal flame stabilization of the combustion flames, gas circulation in the combustion flames is suppressed. Consequently, the outer peripheral portion of the combustion flames is maintained in a low temperature state, and the generation amount of NOx due to the mixing of the fuel gas with the combustion-gas combustion air is reduced. As mentioned above, the combustion burner 21 reduces the flow velocity on a fuel-gas-flow inner side, and causes the flow velocity on a fuel-gas-flow outer side to be substantially equivalent to the flow velocity of a fuel gas flow from the combustion air nozzle 52 thus achieving an appropriate flow capable of suppressing the ignition in the outer periphery of the fuel gas flow. Consequently, it is possible to improve the internal flame stabilization performance so as to cause ignition to start from the inner side of the fuel gas relatively earlier than the outside of the fuel gas, and it is possible to suppress a high-temperature high-oxygen area in the boundary between the fuel gas and the combustion-gas combustion air thus reducing NOx.

The combustion burner 21 provides the respective abrasion-resistant members 104 to the flame stabilizer 54 and the flow straightener 55 that are arranged in the inside of the fuel nozzle 51 thus reducing the abrasion of the surfaces of the flame stabilizer 54 and the flow straightener 55 when the solid contents in the combustion gas are brought into contact with the flame stabilizer 54 and the flow straightener 55. Furthermore, the abrasion-resistant member 94 is provided to the surface 93 of the first flame stabilizing member 61, and the abrasion-resistant members 104, 106 are selectively arranged on the surface 103 and the end portion 105 of the first straightening vane 71, respectively, thus arranging the abrasion-resistant members selectively on the portions where the abrasion is easily generated. To be, more specific, the abrasion-resistant member 94 is capable of suppressing the abrasion of the surface 93 with which the solid contents are easily brought into contact due to the wedge shape of the base materials 92. The abrasion-resistant member 104 is capable of suppressing the abrasion of the surface 103 with which the solid contents are easily brought into contact when the angle of the angle adjustment part 80 is inclined toward the duct part 82. The abrasion-resistant member 106, which is arranged on the end portion 105, is capable of suppressing the abrasion of the end portion 105 with which the solid contents are easily brought into contact.

Furthermore, the combustion burner 21 according to the present embodiment includes the flame stabilizer 54 and the flow straightener 55 in a spaced apart manner thus separately maintaining the flame stabilizer 54 and the flow straightener 55. That is, the flame stabilizer 54 can be replaced independently, and the flow straightener 55 can also be replaced independently. As one example, in the combustion burner 21, in a state that the flow straightener 55 is arranged in the inside of the combustion burner 21, only the distal end portion of the combustion burner 21 is cut out, and detached by using a fixture thus replacing only the flame stabilizer 54. Furthermore, in a state that the flame stabilizer 54 is arranged in the inside of the combustion burner 21, the welded portion of the flow straightener 54 is cut out thus replacing only the flow straightener 54. Consequently, a part to be replaced can be replaced selectively, and the number of parts to be replaced at the time of maintenance can be reduced thus improving maintainability. The number of the parts to be replaced can be reduced thus reducing the total weight of the parts to be replaced. Furthermore, in the combustion burner 21, the distal end portion 86 is formed separately from the proximal portion 84 and hence, the flame stabilizer 54 and the flow straightener 55 are formed separately from each other thus also integrally replacing the distal end portion 86 and the flame stabilizer 54 fixed to the distal end portion 86. Consequently, only the distal end portion 86 can be replaced thus achieving easy maintenance.

Here, the combustion burner 21 may constitute the structure according to the present embodiment at the time of manufacturing, and may constitute the structure according to the present embodiment at the time of maintenance. For example, when maintaining a combustion burner in which a flame stabilizer and a flow straightener differ in shape from the flame stabilizer 54 and the flow straightener 55 according to the present embodiment, respectively, the flame stabilizer may be replaced with the flame stabilizer 54 whose flame stabilizing member has the abrasion-resistant member on the wide width part thereof, and the flow straightener may be replaced with the flow straightener 55 whose straightening vane has the abrasion-resistant member on at least a part thereof. Here, also when maintaining the combustion burner 21 according to the present embodiment, the flame stabilizer is replaced with the flame stabilizer 54 whose flame stabilizing member has the abrasion-resistant member on the wide width part thereof, and the flow straightener is replaced with the flow straightener 55 whose straightening vane has the abrasion-resistant member on at least a part thereof.

In this manner, when maintaining a combustion burner, a flame stabilizer is replaced with another flame stabilizer whose flame stabilizing member has an abrasion-resistant member on the wide width part thereof, and a flow straightener is replaced with another flow straightener whose straightening vane has an abrasion-resistant member on at least a part thereof thus protecting the portion of the combustion burner that is easily worn, and improving the durability of the combustion burner. Furthermore, the abrasion-resistant member is selectively arranged thus decreasing time and efforts for arranging the abrasion-resistant member at the time of maintenance, and easily maintaining the combustion burner. Consequently, it is possible to maintain high durability, and achieve easy maintenance.

Furthermore, the combustion burner 21 includes the flame stabilizer 54 and the flow straightener 55 in a spaced apart manner thus reducing the arrangement area of the flow straightener 55 compared with a case Where the flame stabilizer 54 and the flow straightener 55 are integrally formed with each other. Consequently, it is possible to reduce the area in which the abrasion-resistant member is arranged.

Here, although the flame stabilizer according to the present embodiment has a triangular sectional shape, the present invention is not limited to this example, and a rectangular sectional shape may be applicable. Furthermore, in the above-mentioned embodiment, although the combustion burner 21 has a quadrangular sectional shape, a circular sectional shape, or other polygonal sectional shapes may be applicable.

Figure 7:
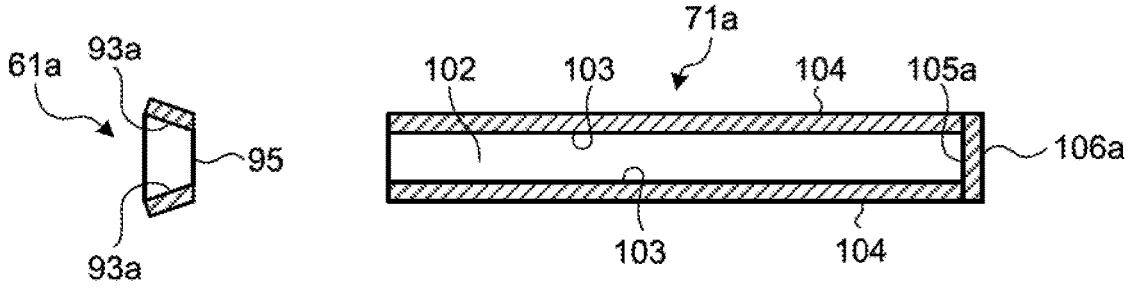
FIG. 7 is a schematic view illustrating a schematic structure of a modification of the flame stabilizing member and the straightening vane.

FIG. 7 is a schematic view illustrating a schematic structure of a modification of the flame stabilizing member and the straightening vane. A first flame stabilizing member 61*a* and a first straightening vane 71*a* that are illustrated in FIG. 7 have abrasion-resistant members on the respective surfaces thereof. The first flame stabilizing member 61*a* is formed in a trapezoidal shape in which a downstream-side surface and an upstream-side surface in the flow direction of the fuel gas constitute an upper base and a lower base, respectively. That is, the first flame stabilizing member 61*a* is formed in a shape in which a part of the vertex side of an isosceles triangle is cut off along a surface parallel to the base of the isosceles triangle (a planar surface orthogonal to the flow direction of the fuel gas). In the first flame stabilizing member 61*a*, the abrasion-resistant member is formed on a surface 93*a*, and the abrasion-resistant member is not formed on a surface 95. Here, the abrasion-resistant member may be formed on the surface 95.

In the first straightening vane 71*a*, an end portion 105*a* that constitutes the rear end of the base material 102 (the end portion on the upstream side in the flow direction of the flue gas) is a planar surface orthogonal to the flow direction of the fuel gas. The first straightening vane 71*a* has an abrasion-resistant member 106*a* on the end portion 105*a* thereof. The abrasion-resistant member 106*a* is formed in a rod-like shape, and can be attached to the base material 102.

In the first flame stabilizing member 61*a*, the end portion located on the flow straightener 55 side constitutes a planar surface orthogonal to the flow direction of the fuel gas, thus changing the direction of the solid contents brought into contact with the first flame stabilizing member 61*a*, and reducing the solid contents to be brought into contact with the other portions. Consequently, it is possible to reduce the solid contents to be brought into contact with the flame stabilizer 54, and improve the abrasion resistance of the flame stabilizer 54.

Furthermore, in the first straightening vane 71*a*, the end portion located on the flow straightener 55 side constitutes a planar surface orthogonal to the flow direction of the fuel gas thus preventing the solid contents from being brought into rubbing contact with the surface of the end portion, and reducing the abrasion of the end portion. Furthermore, in the first straightening vane 71*a*, the end portion 105*a* constitutes a planar surface thus decelerating the solid contents brought into contact with the end portion 105*a* at the end portion 105*a* and thereafter, moving the solid contents along the flow direction of the fuel gas. That is, in the first straightening vane 71*a*, the end portion 105*a* constitutes the planar surface thus changing the direction of movement of the solid contents brought into contact with the end portion 105*a* of the first straightening vane 71*a*, and preventing the solid contents from moving towards other portions arranged in respective positions facing the first straightening vane 71*a*. Namely, the first straightening vane 71*a* changes the direction of movement of the solid contents brought into contact with the end portion 105*a* while maintaining the speed of the solid contents thus preventing the solid contents from being brought into contact with the other portions of the first straightening vane 71*a* after the contact of the solid contents with the end portion 105*a*. Consequently, it is possible to decrease the contact of the solid contents brought into contact with the end portion 105*a*, with the other portions of the first straightening vane 71*a*. Consequently, it is possible to reduce the solid contents to be brought into contact with the flame stabilizer 54, and improve the abrasion resistance of the flame stabilizer 54.

Furthermore, in FIG. 7, although the first flame stabilizing member 61*a* and the first straightening vane 71*a* are included, it is unnecessary to include the first straightening vane 71*a*, and a structure provided with only the first flame stabilizing member 61*a* may be adopted. The first straightening vane 71*a* is not arranged thus reducing the number of components to be maintained.

Figure 8:
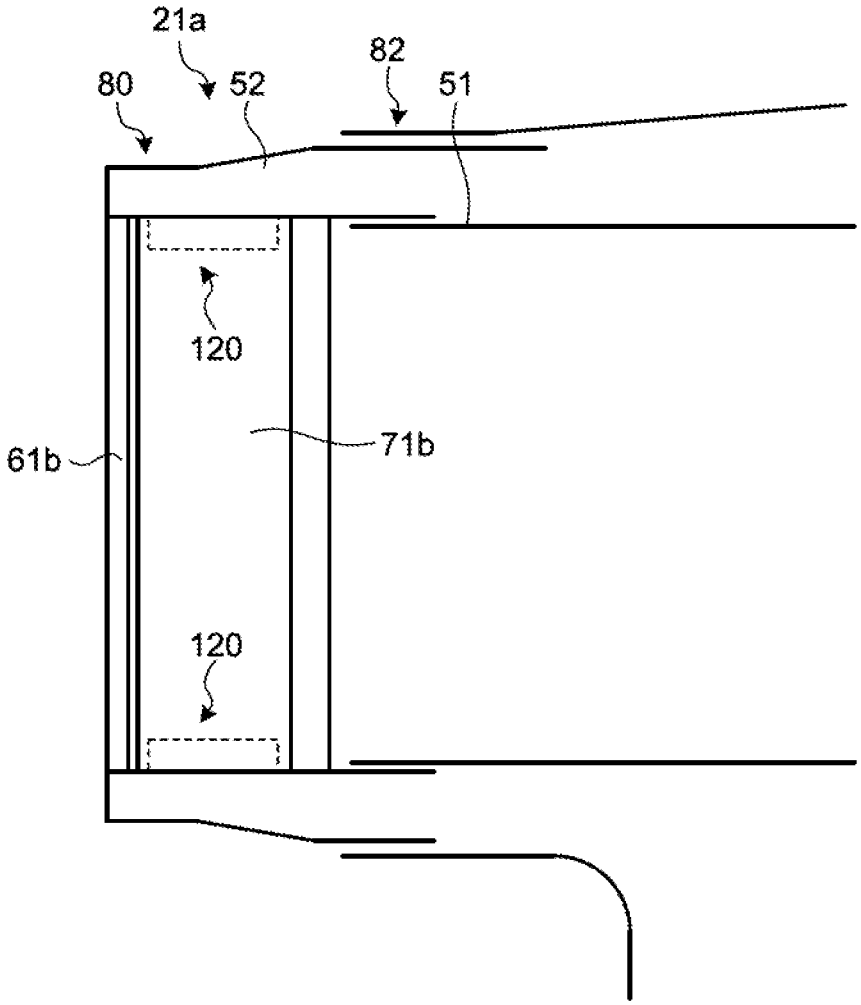
FIG. 8 is a schematic view illustrating a schematic structure of a combustion burner according to another embodiment.
Figure 9:
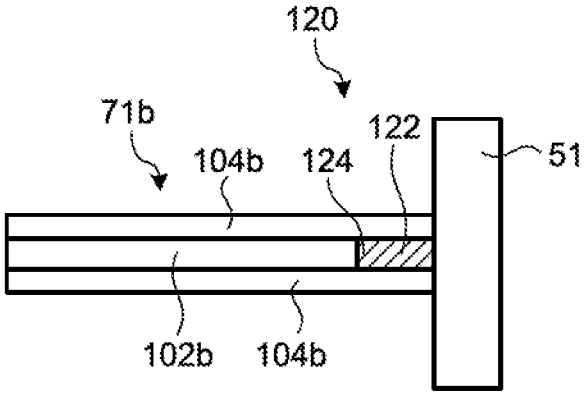
FIG. 9 is an enlarged schematic view illustrating a connection portion between the straightening vane and the combustion nozzle of the combustion burner illustrated in FIG. 8.

FIG. 8 is a schematic view illustrating a schematic structure of a combustion burner according to another embodiment. FIG. 9 is an enlarged schematic view illustrating a connection portion between a straightening vane and a combustion nozzle of the combustion burn illustrated in FIG. 8. The combustion burner 21*a* illustrated in FIG. 8 and FIG. 9 has a first flame stabilizing member 61*b*, and a first straightening vane 71*b*. The first flame stabilizing member 61*b* is similar in structure to the first flame stabilizing member 61. The first straightening vane 71*b* is fixed to the fuel nozzle 51 at the end portion thereof in the horizontal direction (in a direction orthogonal to the flow direction of the fuel gas). The first straightening vane 71*b* and the fuel nozzle 51 are connected with each other by way of a support mechanism 120. The first straightening vane 71*b* has a base material 102*b*, and respective abrasion-resistant members 104*b* arranged on both sides of the base material 102*b*. The base material 102*b* is sandwiched between two abrasion-resistant members 104*b*. In the first straightening vane 71*b*, in the horizontal direction, two abrasion-resistant members 104*b* project to the fuel nozzle 51 side from the base material 102*b*. Consequently, the first straightening vane 71*b* forms a recessed portion 122 surrounded by the base material 102*b* and two abrasion-resistant members 104*b* in the horizontal end portion thereof. The fuel nozzle 51 has a projection portion 124 arranged in a position corresponding to the recessed portion 122.

The support mechanism 120 includes the projection portion 124 in the recessed portion 122 located between two abrasion-resistant members 104*b* and hence, the first straightening vane 71*b* is supported with respect to the fuel nozzle 51. The first straightening vane 71*b* is fixed to the fuel nozzle 51 by welding, screwing, or the like.

The combustion burner 21*a* is constituted in such a manner that the support mechanism 120 has a structure such that the projection portion 124 of the fuel nozzle 51 is sandwiched between the abrasion-resistant members 104*b* thus covering the projection portion 124 of the fuel nozzle 51 with the abrasion-resistant members 104*b*. Consequently, it is possible to bring the combustion burner 21*a* into a state in which the projection portion 124 is not exposed in the inside of the fuel nozzle 51, and it is possible to suppress the deterioration of the projection portion 124. Consequently, the deterioration of the projection portion 124 can be prevented thus using the projection portion 124 as it is when replacing the abrasion-resistant members 104*b*, and achieving easy maintenance. Furthermore, the combustion burner 21*a* is brought into a state in which the projection portion 124 is not exposed and hence, the process for protecting the projection portion 124 against abrasion becomes unnecessary. Consequently, it is possible to decrease an area subject to an abrasion-resistant treatment, and it is possible to achieve easy maintenance.

Figure 10:
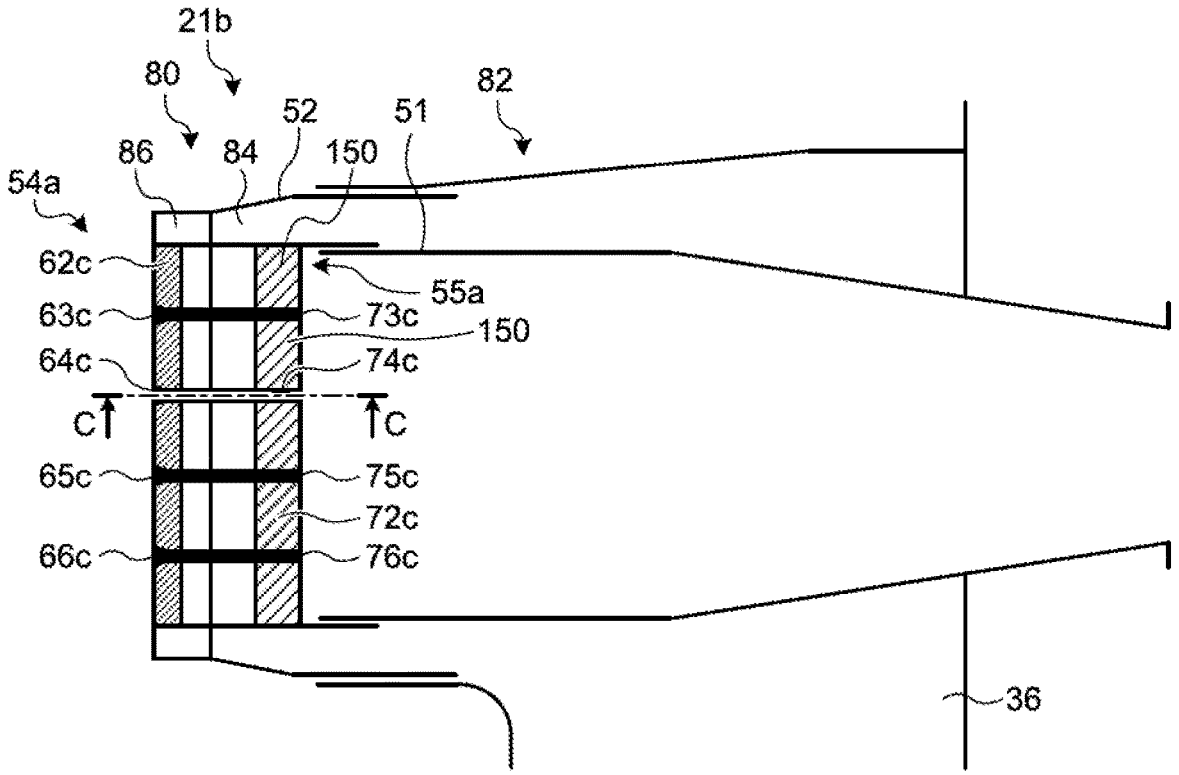
FIG. 10 is a sectional view illustrating a combustion burner of still another embodiment.
Figure 11:
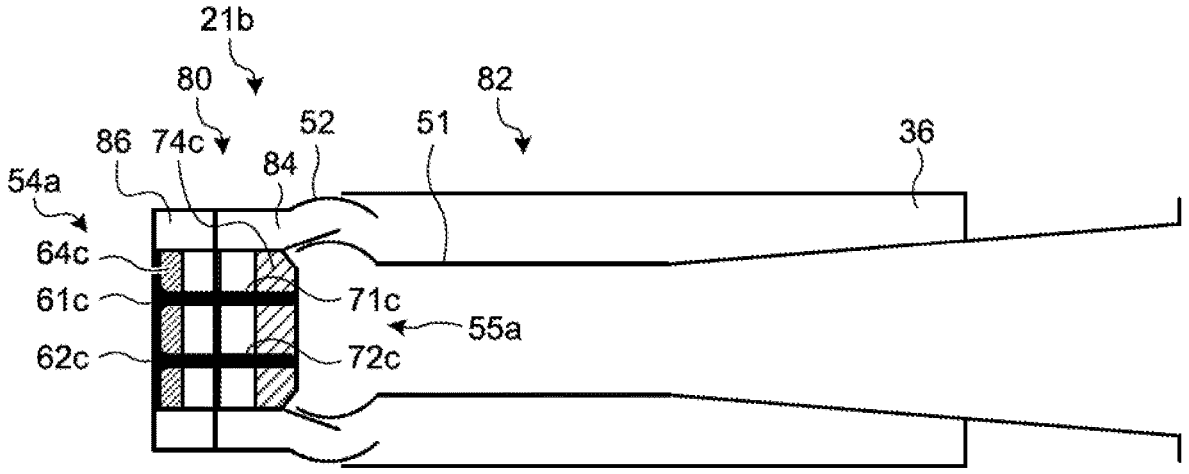
FIG. 11 is a sectional view taken along line C-C in FIG. 10, the sectional view illustrating the combustion burner of the still another embodiment.
Figure 12:
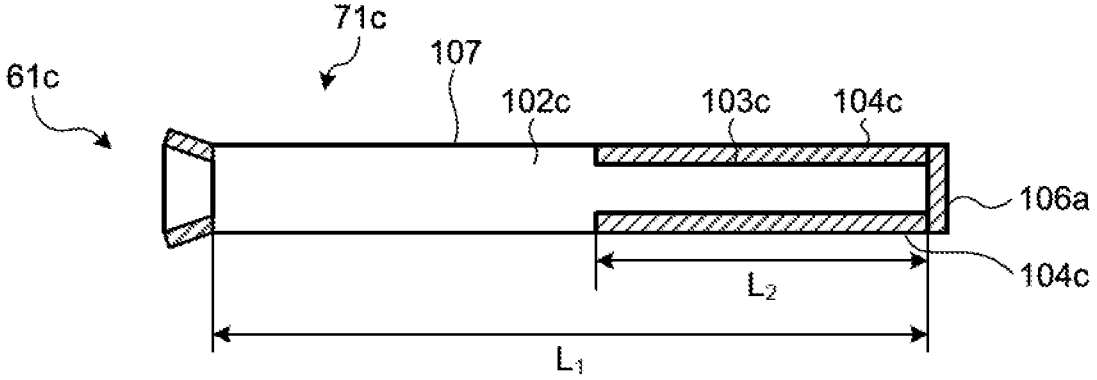
FIG. 12 is a schematic view illustrating a schematic structure of a flame stabilizing member and a straightening vane of the combustion burner illustrated in FIG. 10.

FIG. 10 is a sectional view illustrating a combustion burner of still another embodiment. FIG. 11 is a sectional view taken along line C-C in FIG. 10, the sectional view illustrating the combustion burner of the still another embodiment. FIG. 12 is a schematic view illustrating a schematic structure of a flame stabilizing member and a straightening vane of the combustion burner illustrated in FIG. 10. Although FIG. 12 illustrates only a first flame stabilizing member 61*c* of the flame stabilizer 54 and a first straightening vane 71*c* of a flow straightener 55, the other flame stabilizing member and the other straightening vane are also similar in structure to the first flame stabilizing member 61*c* and the first straightening vane 71*c*, respectively. The combustion burner 21*b* illustrated in FIG. 10 to FIG. 12 has a flame stabilizer 54*a*, and a flow straightener 55*a*. The combustion burn 21*b* is similar in structure to the combustion burner 21 except for the flame stabilizer 54*a* and the flow straightener 55*a*. Furthermore, the flame stabilizer 54*a* and the flow straightener 55*a* are also explained mainly in terms of the constitution that makes the flame stabilizer 54*a* and the flow straightener 55*a* different from the flame stabilizer 54 and flow straightener 55, respectively.

In the combustion burner 21*b*, the flame stabilizer 54*a* and the flow straightener 55*a* are integrally formed with each other. The flame stabilizer 54*a* is constituted so that first flame stabilizing members 61*c*, 62*c* each of which is formed along the horizontal direction, and second flame stabilizing members 63*c*, 64*c*, 65*c*, 66*c* each of which is formed along the vertical direction (up-and-down direction) are arranged in a crossed manner. Each of the first flame stabilizing members 61*c*, 62*c* and the second flame stabilizing members 63*c*, 64*c*, 65*c*, 66*c* is formed in a wedge shape whose width is increased in the direction toward the downstream side in the flow direction of the fuel gas.

The flow straightener 55*a* has first straightening vanes 71*c*, 72*c* each of which is formed along the horizontal direction, and second straightening vanes 73*c*, 74*c*, 75*c*, 75*c* each of which is formed along the vertical direction (up-and-down direction). The first straightening vanes 71*c*, 72*c* and the second straightening vanes 73*c*, 74*c*, 75*c*, 76*c* are, at the respective end portions thereof located on the downstream side in the flow direction of the flue gas, fixed to the first flame stabilizing members 61*c*, 62*c* and the second flame stabilizing members 63*c*, 64*c*, 65*c*, 66*c* that are arranged on the respective extensions thereof, respectively.

The respective structures of the flame stabilizer 54*a* and the flow straightener 55*a* are explained. As illustrated in FIG. 10 to FIG. 12, the straightening vane of the flow straightener 55*a*, the first straightening vane 71*c* in FIG. 12, has an abrasion-resistant member 104*c* on a part located on the upstream side in each surface thereof that is parallel to the flow direction of the fuel gas. That is, the first straightening vane 71*c* has a surface 107, which is a part of the surface of a base material 102*c*, located on the downstream side (flame stabilizer 54*a* side) in the surface thereof that is parallel to the flow direction of the fuel gas, the surface 107 being an exposed area. The base material 102*c* has a stepped portion between the surface 107 and a surface 103*c*, a step height between the surface 107 and the surface of the abrasion-resistant member 104*c* becomes small, and the surface 107 and the surface of the abrasion-resistant member 104*c* are preferably coplanar with each other. Consequently, it is possible to further enhance the advantageous effect of the straightening vane straightening the flow of the fuel gas.

In the first straightening vane 71*c*, when the length (overall length) of the first straightening vane 71*c* in the flow direction of the fuel gas is indicated by a symbol $L_1$, and the length of the abrasion-resistant member 104*c* (the length from the end portion on the upstream side to the end portion on the downstream side in the area where the abrasion-resistant member 104*c* is arranged) is indicated by a symbol $L_2$, it is preferable that the ratio of $L_2$ to $L_1$ be such that $L_2/L_1 \leq 50\%$. For example, it is preferable that the ratio of $L_2$ to $L_1$ be such that $L_2/L_1 = 1/3$. Furthermore, the abrasion-resistant member 104*c* attaches a plate 150 formed in a panel-like shape to the base material 102*c*. The plate 150 is a hardfacing plate, which is a plate formed of metal higher in abrasion resistance than the base material, such as high-chrome steel or the like, by buttered welding. In this manner, the plate 150 is used thus covering a larger area with one plate, and fixing the abrasion-resistant member 104C to the base material 102C in a shorter time, compared with the case where the plate-like member made of ceramics is used.

In the combustion burner 21*b*, the abrasion-resistant member is arranged on a part of the straightening vane on the upstream side in the flow direction of the fuel gas; that is, the abrasion-resistant member is not arranged on the downstream side in the flow direction of the fuel gas thus reducing an area where a countermeasure against abrasion is to be taken. The area where the countermeasure against abrasion is to be taken is reduced thus reducing the treatments of the countermeasure against abrasion to be applied to the straightening vane, also when replacing the straightening vanes at the time of maintenance. Consequently, works at the time of maintenance can be reduced thus achieving easy maintenance. Furthermore, the straightening vane is hardly worn on the downstream side thereof compared with the upstream side thereof. Consequently, even when a structure such that the abrasion-resistant member is not arranged on the downstream side of the straightening vane is adopted, it is possible to suppress the lowering of the abrasion resistance of the straightening vane as a whole, and it is possible to use the combustion burner 21*b* for a long time.

In the present embodiment, although the structure such that the flame stabilizer 54*a* and the flow straightener 55*a* are connected with each other is adopted, as described in the above-mentioned embodiment, the flame stabilizer 54*a* and the flow straightener 55*a* may be arranged in a spaced apart manner. The flame stabilizer 54*a* and the flow straightener 55*a* are arranged in a spaced apart manner thus acquiring the above-mentioned advantageous effect.

Figure 13:
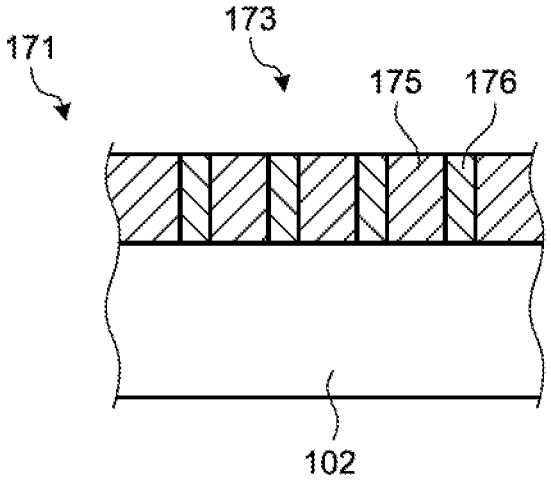
FIG. 13 is a schematic view illustrating a schematic structure of a modification of the straightening vane illustrated in FIG. 12.

FIG. 13 is a schematic view illustrating a schematic structure of a modification of the straightening vane illustrated in FIG. 12. A straightening vane 171 illustrated in FIG. 13 has the base material 102 and an abrasion-resistant member 173. The abrasion-resistant member 173 has a structure such that a ceramic portion 175 is embedded around a metal portion 176 formed in a projection shape. The abrasion-resistant member 173 is manufactured as a structure such that the metal portion 176 is formed in a projection shape by casting or the like. The ceramic portion 175 is embedded on the surface of the structure having the metal portion 176 thus manufacturing the abrasion-resistant member 173. In this manner, the structure such that ceramics and metal, such as high-chrome steel, exist together with each other in the abrasion-resistant member 173 is adopted thus improving the abrasion resistance of the abrasion-resistant member 173.

Figure 14:
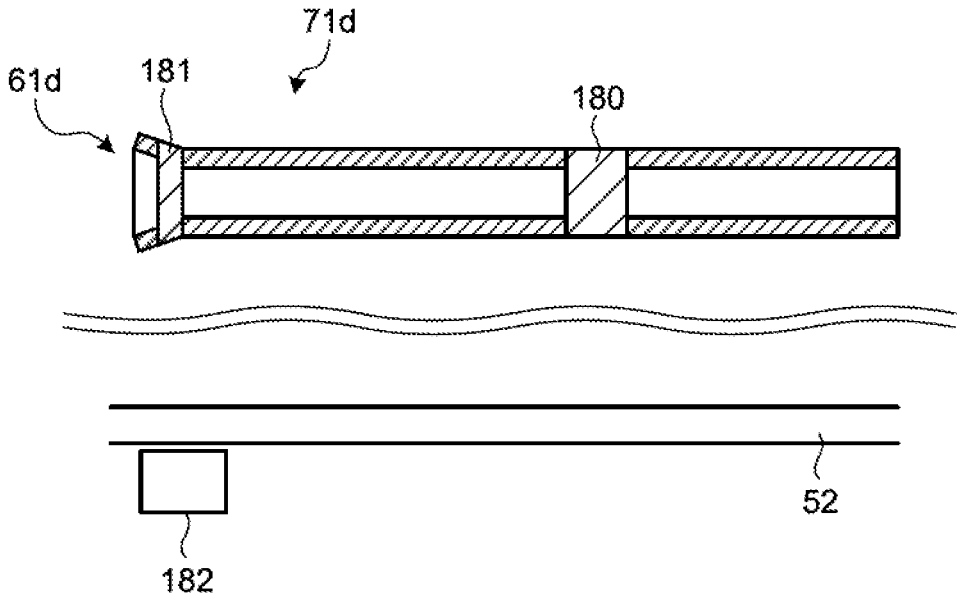
FIG. 14 is a schematic view illustrating a schematic structure of a combustion burner of still another embodiment.

FIG. 14 is a schematic view illustrating a schematic structure of a combustion burner of still another embodiment. A first straightening vane 71*d* illustrated in FIG. 14 is provided with a permanent magnet 180 extending over the whole area thereof in the thickness direction. Furthermore, a first flame stabilizing member 61*d* is provided with a permanent magnet 181 extending over the whole area thereof in the thickness direction. In the combustion burner illustrated in FIG. 14, the first straightening vane 71*d* and the first flame stabilizing member Sid are provided with the permanent magnets 180, 181 extending over the respective whole areas thereof in the thickness direction and hence, the first straightening vane 71*d* and the first flame stabilizing member 61*d* assume respective states in which the permanent magnets 180, 181 are worn by the solid contents in the combustion gas.

In the combustion burner illustrated in FIG. 14, a magnetic force detector 182 is arranged on the outside of the combustion air nozzle 52 or the secondary air nozzle 53 to detect the magnetic force of the permanent magnet 180, or 181 thus detecting the magnetic force that varies by the abrasion of the permanent magnet 180, or 181. Consequently, the combustion burner is provided with the permanent magnets 180, 181 thus detecting the abrasions of the permanent magnets 180, 181 in the area in which the flame stabilizer and the straightening vane are arranged, from the outside of the fuel nozzle 51. Furthermore, the correlative relations between the abrasions of the permanent magnets 180, 181 and the respective abrasions of the first straightening vane 71*d* and the first flame stabilizing member 61*d* are acquired in advance thus detecting the abrasion states of the first straightening vane 71*d* and the first flame stabilizing members 61*d*. In this manner, the abrasion state is detectable from the outside of the fuel nozzle 51 thus determining the necessity of maintenance, and performing the maintenance at an appropriate timing. The maintenance can be performed at an appropriate timing thus suppressing the occurrence of unnecessary maintenance, and achieving a simple maintenance work. For example, to consider a case where an abrasion loss is detected, when the abrasion loss is not less than a predetermined value; to be more specific, when the thickness of a straightening vane or a flame stabilizing member is insufficient to withstand until a next periodical inspection, the component whose abrasion loss is measured is replaced, and when the abrasion loss is less than a predetermined value, the component whose abrasion loss is measured is not replaced and hence, it is possible to efficiently perform the replacement of the component. Furthermore, the magnetic force detector 182 is not always necessary to be arranged in the combustion burner, and can also be arranged at the time of inspection Or the like to measure the magnetic force.

Here, it is preferable to arrange the permanent magnets 181, 182 in respective less-wearing portions of the first straightening vane 71*d* and the first flame stabilizing members 61*d*; for example, in a portion located on the first flame stabilizing member 61*d* side of the first straightening vane 71*d*, or in an inclined face of the first straightening vane 71*d*.

Here, in the combustion burner 21 according to the present embodiment, although the end portion on the downstream side of the flame stabilizer 54 is located at the end portion on the downstream side of the fuel nozzle 51 in the flow direction of the fuel gas; that is, although the end portion on the downstream side of the flame stabilizer 54 is located at a position overlapping with the opening of the combustion burner 21, the present invention is not limited to this example. In the combustion burner 21, the flame stabilizer 54 may be arranged on the distal end side of the fuel nozzle 51. Here, the distal end of the combustion burner 21 includes a flame-stabilizable area that is not damaged by radiation from the furnace in the inside of the nozzle portion of the fuel nozzle 51, in addition to the distal end surface of the fuel nozzle 51. When the combustion burner 21 is, as described in the present embodiment, provided with the angle adjustment part 80, it is preferable to arrange the flame stabilizer 54 in the inside of the angle adjustment part 80.

Furthermore, although the combustion burner 21 according to the present embodiment has the respective abrasion-resistant members on two surfaces of the flame stabilizing member that face each other, and on two surfaces of the straightening vane that face each other, the abrasion-resistant member may be arranged only in one surface. For example, when the combustion burner 21 has a structure in which the angle adjustment part 80 is not arranged, and the combustion burner 21 is arranged in such a manner that the combustion burner 21 is inclined with respect to the duct part 82, the abrasion-resistant member may be arranged on a surface inclined to make an angle smaller than 180° with respect to the axis of the duct part 82.

Although the explanation has been made with respect to an example that uses pulverized coal as a combustion fuel, the present invention is not limited to this example that uses pulverized coal (solid fuel), and the combustion fuel may be a fuel including solid contents; that is, the combustion fuel may be a fuel, such as biomass, residues, or petroleum cokes, or two or more kinds of these fuels may be used for multi-fuel combustion.

Furthermore, in each of the embodiments mentioned above, although the combustion device 12 is constituted so that four combustion burners 21 (22, 23, 24, 25) are arranged on the respective four wall surfaces of the furnace 11, and five sets of four combustion burners (21, 22, 23, 24, 25) are arranged in five stages along the vertical direction, the present invention is not limited to this constitution. That is, it is unnecessary to arrange the combustion burner on the wall surface, and the combustion burner may be arranged at the corner of the furnace. Furthermore, the combustion device may be not only a swirl combustion-type combustion device but also a front combustion-type combustion device in which one combustion device is arranged on one wall surface, or an opposed firing-type combustion device in which two combustion devices are arranged on respective two wall surfaces to face each other in an opposed manner.

REFERENCE SIGNS LIST

10 Pulverized coal fired boiler
11 Furnace
21, 22, 23, 24, 25 combustion burner
51 Fuel nozzle
52 Combustion air nozzle
53 Secondary air nozzle
54 Flame stabilizer
61, 62 First flame stabilizing member
63, 64, 65, 66 Second flame stabilizing member
71, 72 First straightening vane
73, 74, 75, 76 Second straightening vane
80 Angle adjustment part
82 Duct part

The invention claimed is:

1. A combustion burner comprising:
a fuel nozzle configured to blow in fuel gas that is a mixture of solid fuel and air;
a combustion air nozzle configured to blow in air from outside of the fuel nozzle;
at least one flame stabilizer having a wide width part whose width increases in a direction toward a distal end of the fuel nozzle, the flame stabilizer being arranged on the axial center side at the distal end of the fuel nozzle; and
a straightening vane having a plate shape, the straightening vane being arranged on an extension of the flame stabilizer on the upstream side in a flow direction of the fuel gas, wherein
an abrasion-resistant member is arranged on the wide width part of the flame stabilizer, and
an abrasion-resistant member is arranged on at least a part of the straightening vane,
the straightening vane has a surface parallel to the flow direction of the fuel gas, and the abrasion-resistant member is arranged in at least an area of the surface, the area being not greater than 50% of the overall length of the straightening vane from an end surface of the straightening vane located on the upstream side of the straightening vane in the flow direction of the fuel gas, and
the straightening vane is arranged in a spaced-apart manner from the flame stabilizer in the flow direction of the fuel gas.

2. The combustion burner according to claim 1, wherein the flame stabilizer has an end surface located on the upstream side in the flow direction of the fuel gas, the end surface being orthogonal to the flow direction of the fuel gas.

3. The combustion burner according to claim 1, wherein the abrasion-resistant member is arranged on an end surface of the straightening vane located on the upstream side in the flow direction of the fuel gas.

4. The combustion burner according to claim 1, wherein the straightening vane has an end surface located on the upstream side in the flow direction of the fuel gas, the end surface being orthogonal to the flow direction of the fuel gas.

5. The combustion burner according to claim 1, wherein
the fuel nozzle has a projection portion at a position facing the straightening vane, and
the straightening vane has a recessed portion covering a periphery of the projection portion, the straightening vane being held with the projection portion arranged in the recessed portion.

6. The combustion burner according to claim 1, wherein the abrasion-resistant member has a structure such that ceramics is embedded in a metal member.

7. The combustion burner according to claim 1, wherein at least one of the flame stabilizer and the straightening vane has a permanent magnet arranged in an exposed manner to the fuel nozzle.

8. The combustion burner according to claim 1, wherein the flame stabilizer has at least one group of at least two first flame stabilizing members arranged parallel with each other along a horizontal direction in a predetermined spaced apart manner in a vertical direction, and at least two second flame stabilizing members arranged parallel with each other along the vertical direction in a predetermined spaced apart manner in the horizontal direction.

9. A method for maintaining a combustion burner, the combustion burner including a fuel nozzle configured to blow in fuel gas that is a mixture of solid fuel and air, a combustion air nozzle configured to blow in air from outside of the fuel nozzle, at least one flame stabilizer having a wide width part whose width increases in a direction toward a distal end of the fuel nozzle, the flame stabilizer being arranged on the axial center side at the distal end of the fuel nozzle, and a straightening vane having a plate shape, the straightening vane being arranged on an extension of the flame stabilizer on the upstream side in a flow direction of the fuel gas, the method comprising:

replacing the flame stabilizer with another flame stabilizer having the wide width part on which an abrasion-resistant member arranged; and replacing the straightening vane with another straightening vane on which an abrasion-resistant member is arranged on at least a part of the other straightening vane, and wherein the straightening vane is arranged in a spaced-apart manner from the flame stabilizer in the flow direction of the fuel gas.

* * * * *